US006195064B1

(12) United States Patent
Andrews et al.

(10) Patent No.: US 6,195,064 B1
(45) Date of Patent: Feb. 27, 2001

(54) COMMUNICATION EMPLOYING TRIPLY-POLARIZED TRANSMISSIONS

(75) Inventors: Michael R Andrews, Summit; Partha Pratim Mitra, Jersey City, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/379,151

(22) Filed: Aug. 23, 1999

(51) Int. Cl.[7] ..... H01Q 21/26

(52) U.S. Cl. ..... 343/797; 342/361

(58) Field of Search ..... 343/700 R, 797, 343/793, 808, 893; 342/158, 361; 455/91, 130, 39

(56) References Cited

U.S. PATENT DOCUMENTS

| | | | | |
|---|---|---|---|---|
| 2,320,124 | * | 5/1943 | Fobes | 250/20 |
| 5,262,788 | * | 11/1993 | Drabowitch et al. | 342/361 |
| 5,530,347 | | 6/1996 | Heerwegh et al. . | |
| 5,621,752 | * | 4/1997 | Antonio et al. | 375/200 |
| 5,724,666 | * | 3/1998 | Dent | 342/361 |
| 5,892,879 | * | 4/1999 | Oshima | 386/46 |
| 5,933,788 | * | 8/1999 | Faerber et al. | 343/797 |

OTHER PUBLICATIONS

Arye Nehoral, "Vector Sensor Array Processing for Electromagnetic Source Localization", IEEE Trans. On Signal Processing, vol. 42, No. 2, Feb. 1994.

K.–C. Ho, "Efficient Method for Estimating Directions–o–f–Arrival of Partially Polarized Signals with Electromagnetic Vector Sensors", IEEE Trans. On Signal Processing, vol. 45, No. 10, Oct. 1997.

C. Perez–Vega, et al., "A Simple and Efficient Model for Indoor Path–Loss Prediction", Meas. Sci. Technol. 8 (1997) 1166–1173.

J. S. Colburn, et al., "Evaluation of Personal Communications Dual–Antenna Handset Diversity Performance", IEEE Trans. On Vehicular Tech., vol. 47, No. 3, Aug. 1998.

T. S. Rappaport, et al., "Wide–Band Microwave Propagation Parameters Using Circular and Linear Polarized Antennas for Indoor Wireless Channels", IEEE Trans. On Comm., vol. 40, No. 2, Feb. 1992.

C. Chiu, et al., "Polarization Effect on Bit–Error–Rate Performance of Indoor Communication", Microwave and Optical Tech. Letters, vol. 13, No. 3, Oct. 1996.

J–F. Lemieuz, et al. "Experimental Evaluation of Space/Frequency Polarization Diversity in the Indoor Wireless Channel", IEEE Trans. On Vehicular Tech., vol. 40, No. 3, Aug. 1991.

K.–C. Ho, et al., "Linear Dependence of Steering Vectors Associated with Tripole Arrays", IEEE Trans. On Antennas and Propagation, vol. 46, No. 11, Nov. 1998.

(List continued on next page.)

*Primary Examiner*—Don Wong
*Assistant Examiner*—Thuy Vinh Tran
(74) *Attorney, Agent, or Firm*—Henry T. Brendzel

(57) ABSTRACT

Problems of fading in a multi-path environment are ameliorated, and the presence of reflective surfaces is turned from a disadvantage to an advantage, by employing a third polarization direction that effectively creates a third communication channel. This third communication channel can be used to send more information, or to send information with enhanced spatial diversity to thereby improve the overall communication performance. A transmitted signal with three polarization directions is created with a transmitter having, illustratively, three dipole antennas that are spatially orthogonal to each other. To take advantage of the signal with the third polarization direction, the receiver also comprises three mutually orthogonal antenna dipoles.

18 Claims, 4 Drawing Sheets

OTHER PUBLICATIONS

K. T. Wong, et a. "Uni–Vector–Sensor ESPRIT for Multi-source Azimuth, Elevation, and Polarization Estimation", IEEE Trans. On Antennas and Propagation, vol. 45, No. 10, Oct. 1997.

K–C. Tan, et al., "Linear Independence of Steering Vectors of an Electromagnetic Vector Sensor", IEEE Trans. On Signal Processing, vol. 44, No. 12, Dec. 1996.

H. Krim, et al., "Two Decades of Array Signal Processing Research", IEEE Signal Processing Magazine, 1996, vol. 13, No. 4.

H. T. Bertoni, et al., "UHF Propagation for Wireless Personal Communications", Proceedings of the IEEE, vol. 82, No. 9, Sep. 1994.

A. J. Paulraj, et al., "Space–Time Processing for Wireless Communications", IEEE Signal Processing Magazine, Nov. 1997.

R. J. Dinger, et al., "Adaptive Methods for Motion–Noise Compensation in Extremely Low frequency Submarine Receiving Antennas", Proceedings of the IEEE, Oct. 1976.

K–C. Tan, et al., "Uniqueness Study of Measurements Obtainable with an electromagnetic vector Sensor", IEEE 1995.

B. Hochwald, et al., "Identifiability in Array Processing Models with Vector–Sensor Applications", IEEE Trans. On Signal Processing, vol. 44, No. 1, Jan. 1996.

B. Hochwald, et al., "Polarimetric Modeling and Parameter Estimation with Applications to Remote Sensing", IEEE Trans on Signal Processing, vol. 43, No. 8, Aug. 1995.

E. R. Ferrara, Jr., et al., "Direction Finding with an Array of Antennas Having Diverse Polarizations", IEEE, vol. QP–31, No. 2, 1983.

J. D. Means, "Use of Three–Dimensional Covariance Matrix Analyzing the Polarization Properties of Plance Waves", Journal of Geophysical Research, vol. 77, No. 28, Oct. 1972.

* cited by examiner

COMMUNICATION EMPLOYING TRIPLY-POLARIZED TRANSMISSIONS

BACKGROUND OF THE INVENTION

This invention relates to wireless communication. More particularly, this invention relates to use of polarized communication signals.

Prior art systems accept the long-recognized constraint imposed by Maxwell's equations that signals which are transmitted from point A to point B over a free space path that directly connects points A and B, and which differ only in their polarization modes, can comprise at most two independent channels. The reason for this constraint lies in the fact that the polarized transmission coefficients between points A and B form a matrix, T, of rank 2. The prior art, therefore, were always of the view that signals can be usefully transmitted from a point A to point B at most with two polarizations, and realizing thereby at most two independent channels of communication. This is demonstrated in the prior art system of FIG. 1, where a transmitter 10 has one dipole antenna 11 and another dipole antenna 12 and a receiver 20 has one dipole antenna 21 and another dipole antenna 22. Typically, dipole antennas 11 and 12 perpendicular to each other, and so are dipole antennas 21 and 22. The most efficient transfer of information from the transmitter to the receiver occurs when antennas 11 and 12 are in a plane that is perpendicular to the line connecting points A and B, antennas 21 and 22 are in a plane that is parallel to the plane of antennas 11 and 12, and antenna dipole 11 is also in a plane that contains antenna 21. Of course, any other spatial arrangement of antennas 11, 12, 21 and 22 may be used for communicating information from the transmitter to the receiver, except that the effectiveness of the communication is reduced (a greater portion of the transmitted signal energy cannot be recovered), and the processing burden on the receiver is increased (both antennas 21 and 22 detect a portion of the signal of antenna 11 and of antenna 12).

Whether a transmitter has a single antenna (polarized or not) or two polarized antennas (as in FIG. 1), it remains that multi-pathing presents a problem. Specifically, multiple paths can cause destructive interference in the received signal, and in indoor environments that presents a major problem because there are many reflective surfaces that cause multiple paths, and those reflective surfaces are nearby (which results in the multiple path signals having significant amplitudes).

SUMMARY OF THE INVENTION

The problems of fading in a multi-path environment are ameliorated, and the presence of reflective surfaces is turned from a disadvantage to an advantage by employing a receiver that accepts and utilizes signals that are polarized to contain energy in the three orthogonal directions of free space. Even more improved operation is obtained when the transmitter transmits information in three independent communication channels with signals that are polarized so that there is transmitted signal energy in the three orthogonal directions of free space, in a third independent communications channel, The third communication channel can be used to send more information, or to send information with enhanced polarization diversity to thereby improve the overall communication efficiency. A transmitted signal with the third polarization direction is created, illustratively, with a transmitter having a third antenna dipole that is orthogonal to the transmitter's first and second antenna dipoles. To take advantage of the signal with the third polarization direction, the receiver illustratively also comprises three mutually orthogonal antenna dipoles.

DETAILED DESCRIPTION

Figure 1:
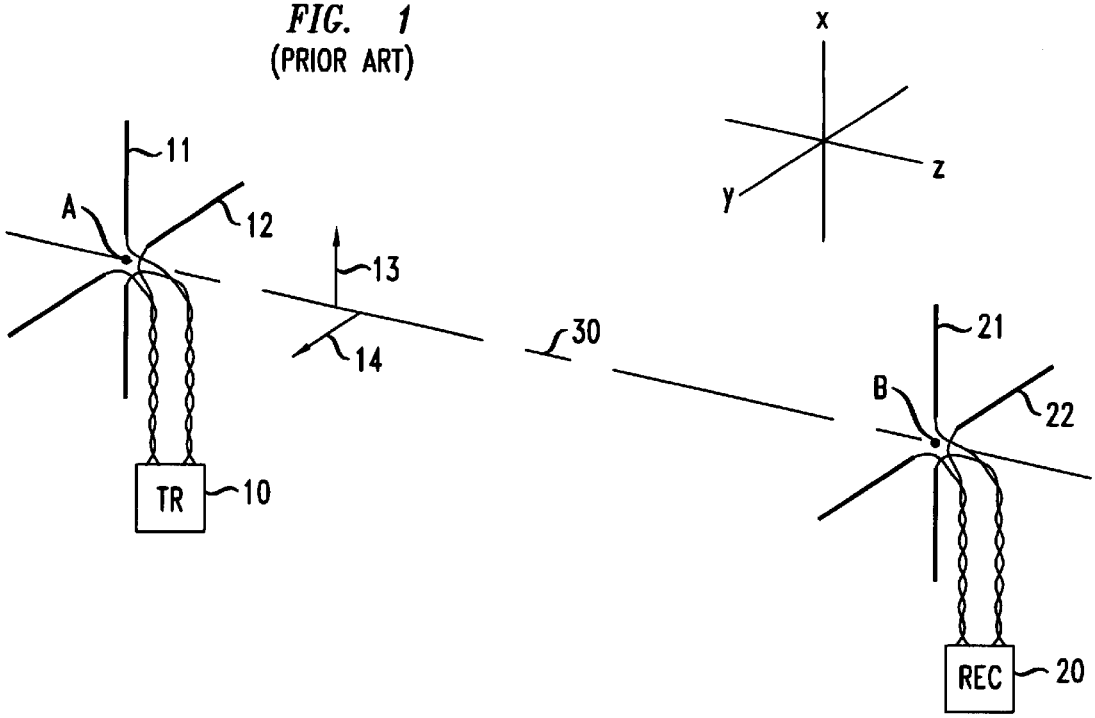
FIG. 1 (PRIOR ART)
FIG. 1 presents a prior art arrangement.

The arrangement of FIG. 1 is shown to employ antenna dipoles that are orthogonal to each other. The arrangements disclosed in the FIGs. that follow FIG. 1, and described herein, are also depicted with antenna dipoles that are orthogonal to each other. It should be understood, however, that these arrangements are so presented for convenience of the description herein. Use of antenna arrangements that are other than three antenna dipoles that are orthogonal to each other, and other than transmitting effectively from one point is within the scope of this invention. The key attribute of a receiving antenna arrangement is that it can receive signals that are effectively polarized in any and all of three mutually orthogonal directions. It is expected, however, that the transmitting and receiving antennas used will be constructed so as to be associated with a single physical hardware unit (such as a base station, mobile wireless terminal, etc.).

As indicated above in connection with the perspective view presented in FIG. 1, the positioning of antennas 11 and 12 relative to antennas 21 and 22 is critical only when the maximum energy is to be transferred from transmitter 10 to receiver 20. In such situations, the plane in which antennas 11 and 12 lie should be parallel to the plane in which antennas 21 and 22 lie, and those planes should be perpendicular to line 30 that connects points A and B. Moreover, antennas 11 and 22 should lie in a common (other) plane. Arrow 13 shows the polarized signal in plane x-z, and arrow 14 shows the polarized signal of plane y-z. Illustratively, arrows 13 and 14 depict the same signal strength.

Figure 2:
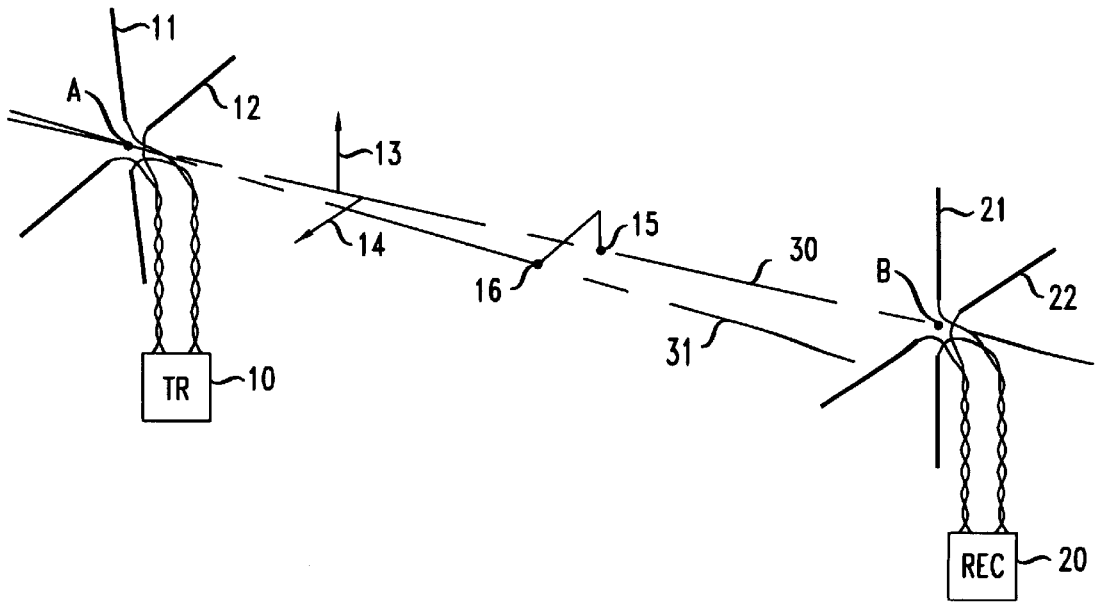
FIG. 2 illustrates a condition where the transmitter antenna are not optimally aligned

Of course, regardless of the orientation of antennas 11 and 12 (relative to antennas 21 and 22), all transmitted signals can be expressed in terms of signals that are polarized along the x axis, the y axis, and the z axis of FIG. 1. An arrangement where the receiver's antenna are at some arbitrary orientation with respect to the transmitter's antennas is shown in FIG. 2, where the antenna 11–12 arrangement is rotated so that the plane in which antennas 11 and 12 lie is perpendicular to line 31. Because the drawing is in two dimensions and it may be difficult to perceive the direction of line 31, assume that point 15 is at a distance R from antennas 11 and 12 along line 30 and the movement of line 30 to coincide with line 31 moves point 15 to point 16. One has to move along the x, y and z axes to go from point 15 to point 16. This demonstrates visually that a signal that is polarized orthogonaly to line 31 can be viewed to have signal components along the x, y and z axes, but those signals do not represent three independent signals.

Expressed mathematically, we can say $$\begin{bmatrix} r_1 \\ r_2 \\ r_3 \end{bmatrix} = \begin{bmatrix} t_{11} & t_{12} \\ t_{21} & t_{22} \\ t_{31} & t_{32} \end{bmatrix} \cdot \begin{bmatrix} s_1 \\ s_2 \end{bmatrix} \tag{1}$$

or $$r = Ts,$$

where the $s_1$ and $s_2$ are the signals sent by antennas 11 and 12, the matrix T reflects the channel's transmission coefficients between points A and B with respect to signals polarized in each of three orthogonal directions, and $r_1$, $r_2$, and $r_3$ are the signals present at the receiver's point B in the three orthogonal directions. The rank of a matrix is the largest square array in that matrix whose determinant does not vanish. Hence, the rank of matrix T is 2.

Of course, the arrangement of FIG. 2 has only two receiver antennas and, therefore, equation (1) degenerates to $$\begin{bmatrix} r_1 \\ r_2 \end{bmatrix} = \begin{bmatrix} t_{11} & t_{12} \\ t_{21} & t_{22} \end{bmatrix} \cdot \begin{bmatrix} s_1 \\ s_2 \end{bmatrix} \tag{2}$$

It can happen that the receiver and the transmitter antennas are aligned in such a way that one of the rows in T contains all zero coefficients, and if the row that contains the all zero coefficients is the first or the second row, then one of the receiver antennas will receive nothing. It can even happen that one of the coefficients in the non-zero row will also be zero, resulting in the situation that one receiving antenna is receiving only one of the sent signals. This is not really any worse than receiving a signal such as $r_1=t_{11}s_1+t_{12}s_2$ with no means to separate $s_1$ from $s_2$.

Figure 3:
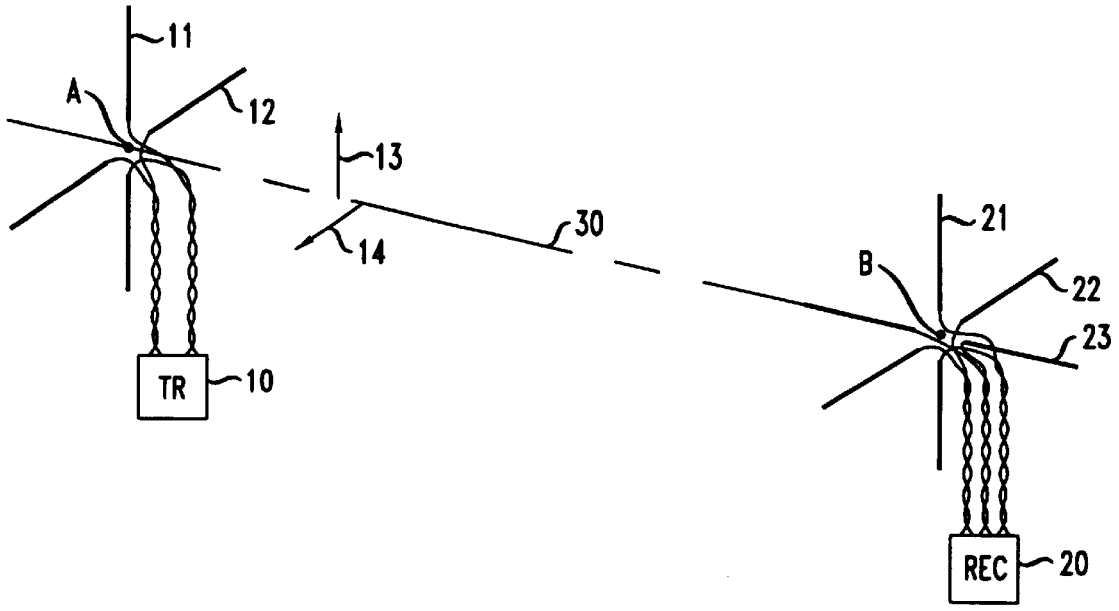
FIG. 3 illustrates a condition if reflective surfaces contributing to the received signal.

Consider, however, the arrangement of FIG. 3, where the antennas of transmitter 10 are arranged as in FIG. 2 while receiver 20 includes a third antenna dipole 23 that is orthogonal to antenna dipoles 21 and 22. The relationship between the transmitted signal and the received signal is then as in equation (1), but now there are three detected signals. Therefore, even if one of the rows in equation (1) degenerates to zero, there are still two signals that are viable. Moreover, since the $s_1$ and $s_2$ signals are transmitted at different polarization directions, the coefficients of a column in T cannot be all zero. Hence, it is always possible to detect the transmitted signals $s_1$ and $s_2$. From the above it can be seen that use of the third receiver antenna obviates the need to align the transmitter and receiver antennas.

Figure 4:
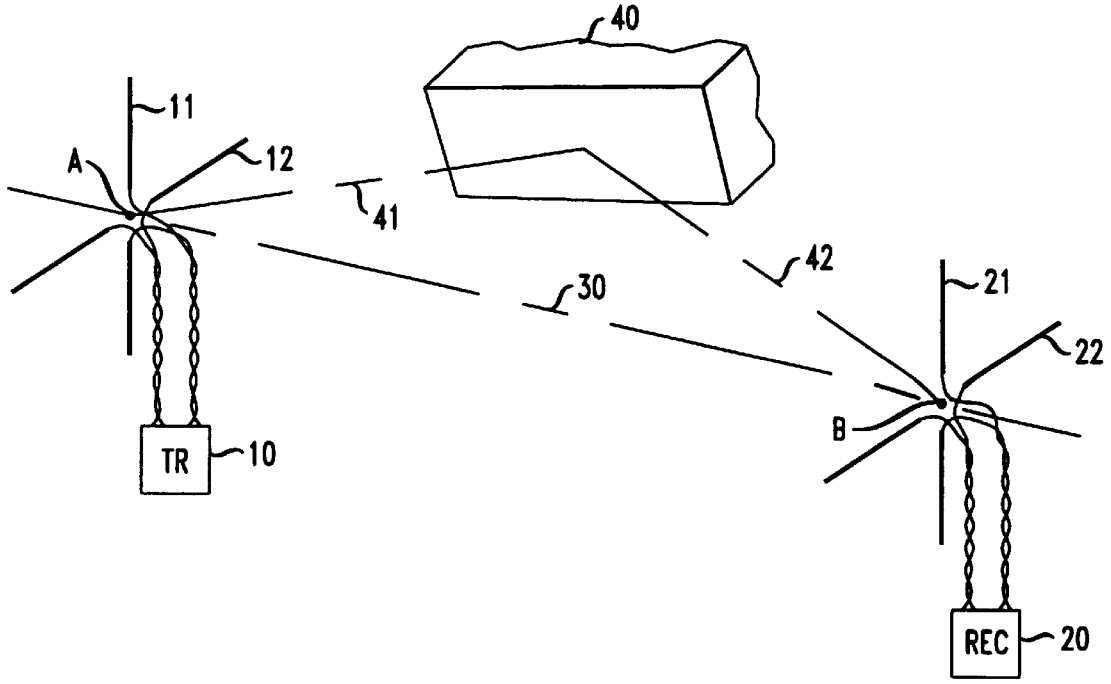
FIG. 4 presents an arrangement where the receiver has three dipole antennas.

Alternatively, consider the situation where the antennas of transmitter 10 are aligned for maximum reception by receiver 20 (as in FIG. 1), but there exists a second, reflective, path between the transmitter and the receiver. This is illustrated in FIG. 4 with a tilted surface 40, where the transmitter has the two antennas 11 and 12 and the receiver has the two antennas 21 and 22. It can be readily observed that there exists a path 41–42 that starts at transmitter 10, bounces off surface 40 and arrives at receiver 20. The direction of the signal that arrives via path 41–42 is not along path 30 (i.e. impinges at an angle other than 90 degrees relative to the plane at which antennas 21 and 22 lie). The signals arriving at point B can be expressed by $$\begin{bmatrix} r_1 \\ r_2 \\ r_3 \end{bmatrix} = \begin{bmatrix} t_{11} & t_{12} \\ t_{21} & t_{22} \\ t_{31} & t_{32} \end{bmatrix} \cdot \begin{bmatrix} s_1 \\ s_2 \end{bmatrix} + \begin{bmatrix} t_{13} & t_{14} \\ t_{23} & t_{24} \\ t_{33} & t_{34} \end{bmatrix} \cdot \begin{bmatrix} s_1 \\ s_2 \end{bmatrix} \tag{3}$$

or $$\begin{bmatrix} r_1 \\ r_2 \\ r_3 \end{bmatrix} = \begin{bmatrix} t_{11}+t_{13} & t_{12}+t_{14} \\ t_{21}+t_{23} & t_{22}+t_{24} \\ t_{31}+t_{33} & t_{32}+t_{34} \end{bmatrix} \cdot \begin{bmatrix} s_1 \\ s_2 \end{bmatrix} = \begin{bmatrix} t'_{11} & t'_{12} \\ t'_{21} & t'_{22} \\ t'_{31} & t'_{32} \end{bmatrix} \cdot \begin{bmatrix} s_1 \\ s_2 \end{bmatrix} \tag{4}$$

or $$r = T's$$

Figure 5:
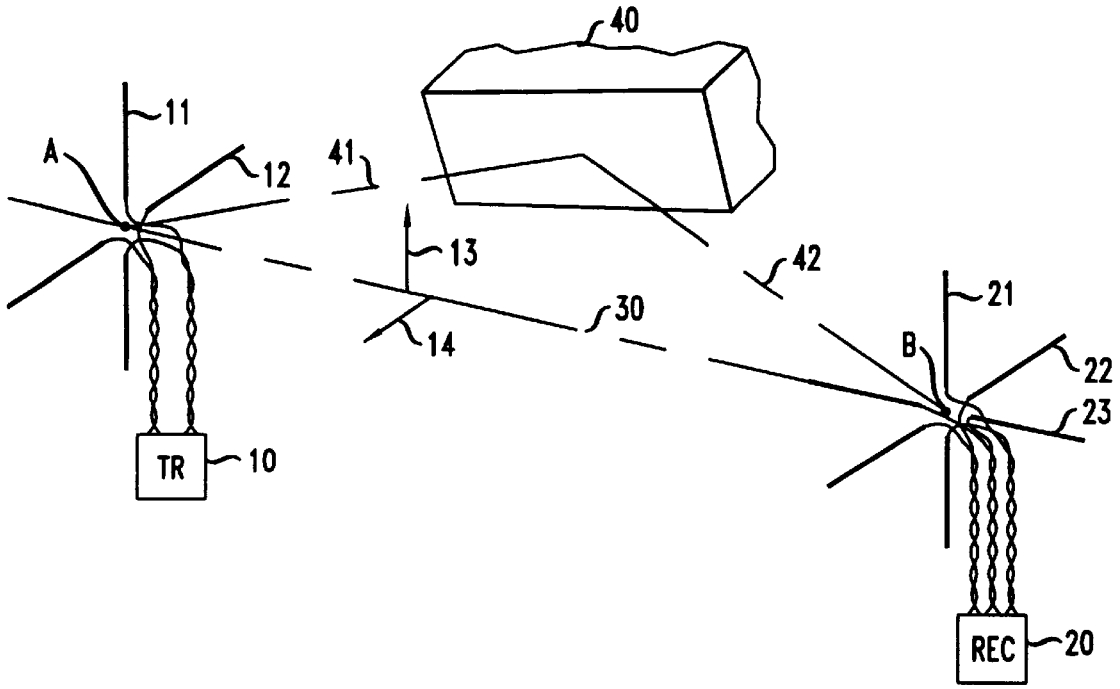
FIG. 5 presents an arrangement where the receiver has three dipole antennas.

Moreover, in an arrangement that has only two receiver antennas at point B, and equation (4) degenerates to $$\begin{bmatrix} r_1 \\ r_2 \end{bmatrix} = \begin{bmatrix} t'_{11} & t'_{12} \\ t'_{21} & t'_{22} \end{bmatrix} \cdot \begin{bmatrix} s_1 \\ s_2 \end{bmatrix}, \tag{6}$$

the likelihood of any row having all zero terms is still quite small. Fading can be reduced even in the face of this small likelihood in the arrangement of FIG. 5, where the receiver has antennas 21, 22, and 23, adapted to receive the signals $r_1$, $r_2$, and $r_3$ of equation (5).

Figure 6:
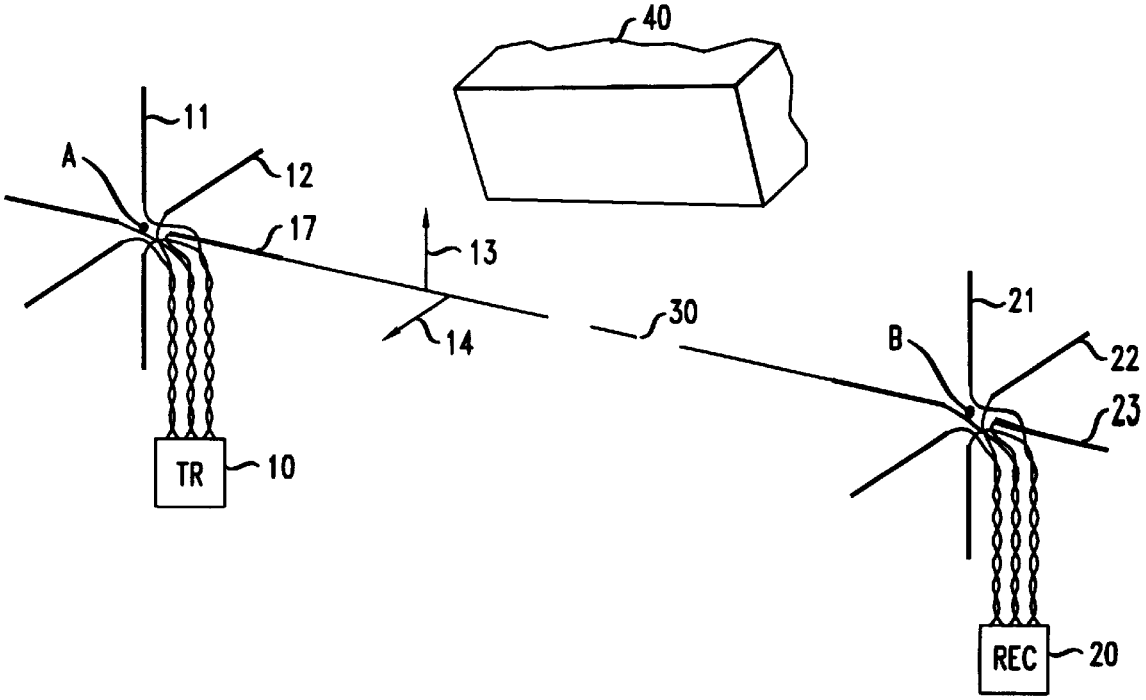
FIG. 6 presents an arrangement where both the transmitter and the receiver have three dipole antennas.

FIG. 6 depicts an arrangement where both transmitter 10 and receiver 20 employ three mutually orthogonal antennas, in an environment with multipathing. In this case, the transfer finction is represented by r=T's where $$T' = \begin{bmatrix} t'_{11} & t'_{12} & t'_{13} \\ t'_{21} & t'_{22} & t'_{23} \\ t'_{31} & t'_{32} & t'_{33} \end{bmatrix}. \tag{7}$$

It can be shown that the matrix T' matrix is of rank 3 and is, therefore, able to sustain three independent channels of information. Therefore, the transmitter 10 of FIG. 6 advantageously is able to transmit three independent signals, making the FIG. 6 arrangement well suited for high data rate transmissions in cellular environments in the presence of multi-paths, such as indoors. The third independent channel can be used to send additional information, it can be used to send the information with additional redundancy, or a combination of the two.

Figure 7:
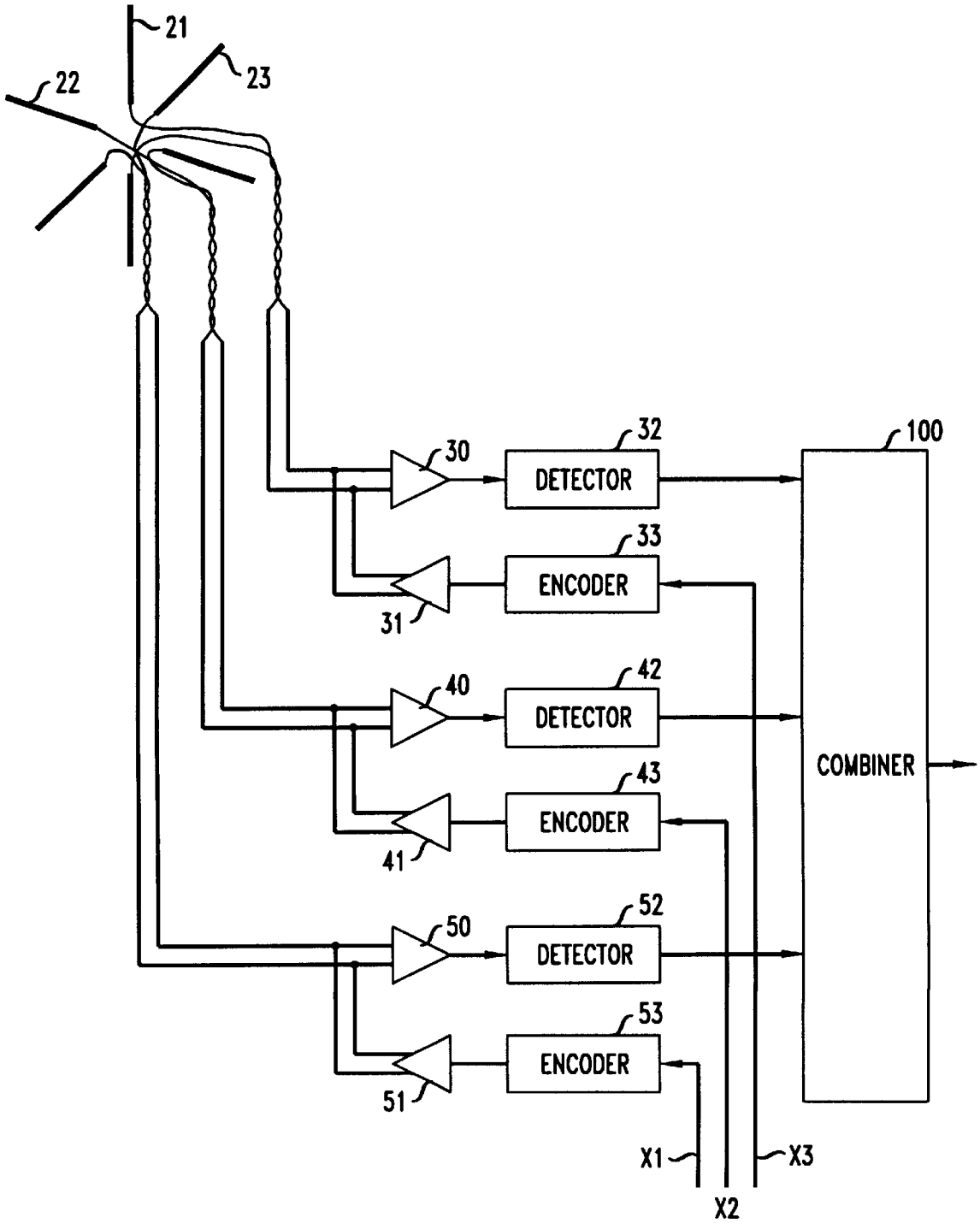
FIG. 7 presents a block diagram of a transceiver in conformance with the principles disclosed herein.

FIG. 7 presents in block diagram form the structure of a transceiver unit that employs three dipole antennas that are orthogonal to each other. Antennas 21, 22, and 23 each are connected to a port which receives signals from its antenna, and feeds signals to its antenna. Illustratively in FIG. 7, antenna 22 feeds signals to receiver 30, and transmitter 31 feeds signals to antenna 11. Receiver 30 applies its output signal to detector 32, which detects the signal $r_1$ and sends it to processor 100. Similarly, receiver 40 receives the signal of antenna 23, applies its output signal to detector 42, and detector 42 detects the signal $r_2$ and sends it to processor 100. Likewise, receiver 50 receives the signal of antenna 21, applies its output signal to detector 52, and detector 52 detects the signal $r_2$ and sends it to processor 100. By conventional means (e.g. involving the reception of known pilot signals, the elements of T' are known to processor 100, and processor 100 computes the signals $s_1$ $s_2$, and $s_3$ by evaluating $$s=(T')^{-1}r.$$

To transmit, signals x1, x2, and x2 are applied to encoders 33, 43, and 53, respectively, where they are encoded and applied to transmitters 31, 41, and 51, respectively. Transmitters 31, 41, and 51 feed their signals to antennas 22, 23, and 21.

The above discloses principles of this invention by means of illustrative embodiments. It should be understood that other embodiments can be employed, and that some of the characteristics of the illustrated embodiments do not necessarily form requirements of a viable design. By way of example, it should be realized that while it may be desirable to have the three dipole antennas spatially orthogonal to each other, an arrangement that does not quite have this orientation will still work. In the context of the this disclosure, therefore, the term "orthogonal," where appropriate, includes "substantially orthogonal."

We claim:

1. A communication unit comprising:

an antenna arrangement responsive to three applied signals, for transmitting the three applied signals at three different directions of polarization, and an encoder responsive to an applied input signal for developing said three applied signals.

2. The unit of claim 1 where the three different directions are orthogonal to each other.

3. The unit of claim 1 where said antenna arrangement comprises a plurality of antenna elements.

4. The unit of claim 3 where said antenna elements are physically within one wavelength of each other.

5. The unit of claim 1 where said antenna arrangement comprises antenna dipoles.

6. The unit of claim 5 where said antenna dipoles are substantially orthogonal to each other.

7. A communication unit comprising:

an antenna arrangement for receiving a signal that was transmitted by a transmitter in a polarized manner, where said signal is polarized in at least a first direction and a second direction, said first direction and said second direction being different from each other, a first detector for detecting signals received by said antenna arrangement that are polarized in a fourth direction, a second detector for detecting signals received by said antenna arrangement that are polarized in a fifth direction that is different from said fourth direction, a third detector for detecting signals received by said antenna arrangement that are polarized in a sixth direction that is different from said fourth direction and from said fifth direction, and a processor responsive to said first detector, said second detector and said third detector, for recovering signals embedded in said signals detected by said first detector, said second detector and said third detector.

8. The unit of claim 7 where said processor solves a set of simultaneous equations.

9. The unit of claim 7 where said signal received by said antenna arrangement is also polarized in a third direction that is different from said first direction and from said second direction.

10. The unit of claim 9 where said first direction, said second direction and said third direction are substantially orthogonal to each other.

11. The unit of claim 7 where said first direction and said second direction are substantially orthogonal to each other.

12. The unit of claim 7 where said first direction is substantially orthogonal to said second direction.

13. The unit of claim 7 where said antenna arrangement comprises a plurality of antenna elements.

14. The unit of claim 7 where said antenna elements are physically within one wavelength of each other.

15. The unit of claim 7 where said antenna arrangement comprises antenna dipoles.

16. The unit of claim 7 where said antenna dipoles are substantially orthogonal to each other.

17. The unit of claim 7 where said antenna arrangement comprises a first signal output port that feeds said first detector, a second signal output port that feeds said second detector, and a third signal output port that feeds said third detector.

18. A transceiver comprising:

an encoder responsive to an applied input signal for developing three signals;

an antenna arrangement responsive to said three signals, for transmitting a first one of said three signals at a first polarization direction, a second one of said three signals at a second polarization direction, and the third one of said three signals at a third polarization direction, where the first, second, and third polarization directions are different from each other;

a first detector for detecting a signal transmitted by a transmitter and received by said antenna arrangement that is polarized in said first direction;

a second detector for detecting a signal transmitted by said transmitter and received by said antenna arrangement that is polarized in said second direction;

a third detector for detecting a signal transmitted by said transmitter and received by said antenna arrangement that is polarized in said third direction, and a processor responsive to said first detector, said second detector, and said third detector.

* * * * *